US010006236B2

(12) United States Patent
Hellwig et al.

(10) Patent No.: US 10,006,236 B2
(45) Date of Patent: Jun. 26, 2018

(54) DOOR DRIVE

(71) Applicant: DORMA Deutschland GmbH, Ennepetal (DE)

(72) Inventors: Alexander Hellwig, Ennepetal (DE); Volker Bienek, Ennepetal (DE); Thomas Wildförster, Ennepetal (DE); Thomas Salutzki, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 89 days.

(21) Appl. No.: 15/177,060

(22) Filed: Jun. 8, 2016

(65) Prior Publication Data

US 2016/0362925 A1 Dec. 15, 2016

(30) Foreign Application Priority Data

Jun. 10, 2015 (EP) ..... 15171537

(51) Int. Cl.

| | |
|---|---|
| ***E05F 3/04*** | (2006.01) |
| ***E05F 3/10*** | (2006.01) |
| ***E05F 3/12*** | (2006.01) |
| *E05F 3/22* | (2006.01) |

(52) U.S. Cl.

CPC ..... *E05F 3/04* (2013.01); *E05F 3/10* (2013.01); *E05F 3/12* (2013.01); *E05F 3/227* (2013.01); *E05Y 2201/458* (2013.01); *E05Y 2600/12* (2013.01); *E05Y 2800/172* (2013.01); *E05Y 2800/174* (2013.01); *E05Y 2900/132* (2013.01)

(58) Field of Classification Search

CPC ..... E05F 3/02; E05F 3/04; E05F 3/10; E05F 3/12; E05F 3/227

USPC ..... 16/49, 51, 56, 66

See application file for complete search history.

(56) References Cited

U.S. PATENT DOCUMENTS

| | | | | | |
|---|---|---|---|---|---|
| 5,657,511 | A * | 8/1997 | Lan | E05F 3/02 | 16/51 |
| 5,832,561 | A * | 11/1998 | Bienek | E05F 3/104 | 16/53 |
| 5,862,630 | A * | 1/1999 | Krumhauer | E05F 3/102 | 49/340 |
| 5,992,444 | A * | 11/1999 | Junttila | E05F 3/12 | 137/599.11 |
| 6,618,899 | B1 * | 9/2003 | Ginzel | E05F 3/10 | 16/51 |
| 8,547,046 | B2 * | 10/2013 | Burris | E05F 3/227 | 16/49 |

(Continued)

FOREIGN PATENT DOCUMENTS

| | | | |
|---|---|---|---|
| DE | 3519477 | A1 | 12/1986 |
| DE | 102010008167 | A1 | 8/2011 |
| GB | 744423 | A | 2/1956 |

*Primary Examiner* — Roberta S Delisle

(74) *Attorney, Agent, or Firm* — Cantor Colburn LLP

(57) ABSTRACT

A door drive includes a housing and at least one regulating valve for the adjustable regulation of a fluid flow within the door drive.

The one regulating valve or at least one of the several regulating valves includes two ends with respectively one engaging part, in particular for a tool, wherein the one regulating valve or the regulating valves extend/s in such a manner through the housing that the engaging parts for adjusting the one regulating valve or the regulating valves may be manipulated from outside the housing.

13 Claims, 7 Drawing Sheets

(56) References Cited

U.S. PATENT DOCUMENTS

2009/0051171 A1* 2/2009 Yamamuro ..... E05F 1/1041
292/163

* cited by examiner

DOOR DRIVE

CROSS-REFERENCE TO RELATED APPLICATIONS

This application is related to and claims the benefit of European Patent Application No. 15171537.2, filed on Jun. 10, 2015, the contents of which are herein incorporated by reference in their entirety.

TECHNICAL FIELD

The disclosure relates to a door drive having a housing and at least one regulating valve for the adjustable regulation of a fluid flow within the door drive. Furthermore, the disclosure relates to a method for manufacturing a door drive and a method for adjusting the regulation of a fluid flow within a door drive.

BACKGROUND

Conventional door drives include at least one regulating valve for the adjustable regulation of a fluid flow within the door drive. Generally, the fluid to be regulated is hydraulic oil. Hereby, the regulating valve regulates the fluid flow, for example in that the regulating valve affects the cross-sectional surface of a fluid channel at least at one portion of the fluid channel. Typical fields of application are dampening functions for dampening the movement of the door leaf, which is in operative connection with the door drive.

Usually, the setting of the regulating valves of a door drive is effected in the final mounting position, i. e. when the door drive is operatively connected to the door. This is required, because, on account of the multiplicity of different doors with correspondingly different features, a preliminary adjustment of the regulating valve is not reasonable. From the point of view of production techniques, an adaptation of the door drive to a specific door variant is not desired, because it is considerably less expensive to produce the least possible number of variants of one door drive. Furthermore, it may be required that the regulation of the fluid flow needs to be readjusted after a certain period of time. This circumstance results in the fact that the regulating valve will have to be accessible for an operator in the mounting position for adjusting the regulation. With the intention to protect the regulating valves from being damaged by inappropriate manipulation, in particular the engaging parts of the regulating valves are manufactured from robust materials, such as metal.

Door drives pertaining to the group of overhead door closers, the housing thereof may be mounted to both the door leaf and the door frame, to the door casing or to the wall, in which the door is recessed. Furthermore, it is distinguished between mounting to the pull-side or the push-side, as well as the mounting to DIN-left-handed doors or DIN-right-handed doors.

One group of conventional door drives is disadvantageous in that for covering all possible combinations of the above described mounting variants at least two variants of the door drive need to be manufactured, because only one variant will not guarantee that in each case the regulating valves are accessible to an operator for adjusting the regulation. Alternative conventional door drives use only one variant of the door drive for covering all potential combinations of the above described mounting variants, however, they do have restricted functionality. These door drives are in particular not functioning over a door opening angle of at least 180°, because these door drives need to employ a symmetric cam disk, instead of an asymmetric cam disk, for being able to reduced the number of variants from two to one.

Another group of conventional door drives bypasses the disadvantage of imposed multiplicity of variants in that two regulating valves are provided for each regulation of a fluid flow in these door drives, wherein in the mounting position at least one of the regulating valves is accessible for an operator for adjusting the regulation. However, this circumstance is disadvantageous in that the increased number of components increases the cost of the door drive and the reliability of the door drive decreases. Furthermore, additional construction space is necessary in the door drive for the additional regulating valves and the additional hydraulic channels. Furthermore, prior to mounting, the regulating valves, which are no longer accessible in the mounting position, need to be completely closed, so as to allow for being able to adjust the regulation of the fluid flows within the door drive in the mounting position with the accessible regulating valves. Hereby, it is particularly problematic, if, in the mounting position, it becomes clear that a no longer accessible regulating valve is not closed. In this case, the regulation of the corresponding fluid flow is only possible in a restricted way or not at all, unless the door drive will be dismounted from the mounting position thereof and the not closed regulating valve will be subsequently closed.

SUMMARY

Therefore, the disclosure provides a door drive, which is suitable for several mounting positions and is inexpensive. Furthermore, the disclosure provides a method for manufacturing a door drive, which allows for an inexpensive and simple manufacturing of a door drive. Furthermore still, the disclosure to provides a method for adjusting the regulation of a fluid flow within a door drive, which method allows for the adjustment of the regulation of a fluid flow within a door drive in a simple manner.

The above is solved based on the initially described door drive in that the one regulating valve or at least one of the several regulating valves includes two ends with respectively one engaging part, in particular for a tool, wherein the one regulating valve or the regulating valves extend in such a manner through the housing that the engaging parts for adjusting the one regulating valve or the regulating valves may be manipulated from outside the housing. Hereby, it is achieved that even though an engaging part of a regulating valve is for example concealed on account of the mounting position and may therefore not be manipulated, at least another engaging part is still accessible for an operator.

The door drive may be disposed in particular directly at or in the door leaf, at or in the wall, at or in the door encasing or at or in the floor.

The door drive may be selected in particular from the group of overhead door closers, door closers mounted in the door, frame door closers or floor door closers.

The door drive may be embodied as a mechanical door drive or as a door drive operated with auxiliary force.

Mechanical door drives are often referred to as door closers or door closing means with a controlled closing sequence. A door closer is able to accumulate at least a portion of the energy deployed during the opening procedure of the door by means of a user for opening the door. After the user releases the door leaf, the door closer may utilize the accumulated energy for automatically closing the door leaf.

In a door drive operated with auxiliary force, it may be in particular an electromechanical and/or an electrohydraulic and/or a pneumatic door drive, wherein the door leaf may be likewise closed and/or opened by means of electromechanically, electrohydraulically and/or pneumatically generated auxiliary force. In this case, the auxiliary force may be dimensioned such that the auxiliary force acts in an assisting manner, i. e. the user needs to exert a reduced force on his own for opening and/or closing the door. The auxiliary force may be likewise dimensioned such that the door is automatically opened by means of the auxiliary force, i. e. that the user does not need to exert a force on his own in addition to the auxiliary force. Preferably, the auxiliary force is adjustable, in particular as a function of the opening angle of the door leaf.

Preferably, in the event of a failure of the auxiliary force, the door drives operated with auxiliary force continue to fulfill the functions of a mechanical door drive, in particular the function of the automatic closure of the door.

Preferably, door drives include at least one safety device. The safety device may limit in particular the opening force and/or the opening speed. The safety device may monitor in particular the pivoting range of the door leaf and trigger a safety function in the event a person or an object would get into the pivoting range of the door leaf. A safety function may comprise for example stopping the door leaf.

Preferably, door drives include at least one monitoring device. The monitoring device may include in particular sensors, which are able to detect hazardous environmental conditions, such as fire, smoke development or dangerous concentrations of gases (e. g. carbon monoxide). After having detected dangerous environmental conditions, the monitoring device may trigger a safety function. A safety function may comprise for example suspending an automatic opening function of the door.

The monitoring device and the safety device may be configured to be separately or they may form a common assembly.

Preferably, door drives include at least one pulse generator. The pulse generator may issue in particular the command for opening and/or for closing the door. The command issued by the pulse generator will be processed by a control, wherein the control controls the door leaf movement commanded by the pulse generator. Pulse generators are distinguished as intentional pulse generators (e. g. switches, buttons) via which the door leaf movement is intentionally initiated, and unintentional pulse generators (e. g. light barriers, radar, contact mats) via which the door leaf movement is unintentionally initiated, when entering a space that is monitored by means of the pulse generator.

Furthermore, door drives may control or regulate the closing movement of the door leaf in such a manner that the closing procedure may be delayed for a certain time, in particular an adjustable time. Said dampening function is also referred to as a closing delay.

According to a preferred embodiment of the door drive, the housing is essentially configured in a cuboid form. Decorative elements, which cover parts of the housing or else essentially cover the housing, may be disposed at the housing. Preferably, the housing is manufactured from one material. In particular, the housing may be manufactured from a metal material. Furthermore, it is preferred that the housing be configured from one piece. However, the housing may be formed from several partial pieces. The housing may be configured at least partially from plastic material.

Furthermore, it may be intended that the one regulating valve or the several regulating valves be disposed in such a manner that, in any mounting position of the door drive, at least one engaging part per regulating valve is accessible for an operator. It will be achieved hereby that in any mounting position each regulating valve will be adjustable.

Furthermore, it may be intended that the one regulating valve or at least one of the several regulating valves extend in a bearing or in a thread. Hereby, it will be achieved that the regulating valve or at least one of the regulating valves be reliably guided in the housing.

Furthermore, it may be intended that the one regulating valve or at least one of the several regulating valves be supported in a valve sleeve, wherein the valve sleeve is accommodated in the door drive, in particular in a throughbore. Hereby, it will be achieved that the regulating valve or at least one of the several regulating valves may be premounted in the valve sleeve separately from the door drive. The valve sleeve may be formed by means of a tube open at both ends.

Furthermore, it may be intended that the one valve sleeve or at least one of the several valve sleeves be accommodated non-positively and/or positively and/or positively by material in the door drive. Hereby, it will be achieved that the valve sleeve or at least one of the several valve sleeves be reliably connected to the door drive.

Furthermore, it may be intended that the one valve sleeve or at least one of the several valve sleeves include at least one lateral opening for passing a fluid flow therethrough. Hereby, it will be achieved that the regulating valve supported in the valve sleeve or at least one of the several regulating valves supported in valve sleeves be able to interact with the fluid flow within the door drive in a simple and direct manner. Such a lateral opening allows for a fluid flow to flow both from the door drive into the regulating valve and also in the reverse direction. Furthermore, it may be intended that one valve sleeve or at least one of the several valve sleeves include at least two lateral openings for passing a fluid flow therethrough. Hereby, a fluid flow from the door drive may flow through one of the two openings into the regulating valve, and a fluid flow may flow from the regulating valve into the door drive through the other one of the two openings. In particular, the flow direction may as well be limited to one of the two possible flow directions.

Furthermore, it may be intended that an orifice be associated to the one regulating valve or to at least one of the several regulating valves, wherein the regulating valve cooperates with the associated orifice in such a manner that the covering degree of the orifice opening depends on the position of the regulating valve in relation to the position of the orifice. Hereby, it will be achieved that very few structural components will allow for a simple regulation of a fluid flow within the door drive. Hereby, the orifice may be attached to the door drive directly or indirectly, for example via the valve sleeve. In particular, the orifice may be configured integrally with the valve sleeve or the door drive.

Furthermore, it may be intended that the one regulating valve or at least one of the several regulating valves includes a first valve piston and a second valve piston, wherein the first valve piston includes the first engaging part and the second valve piston includes the second engaging part, wherein the first valve piston and the second valve piston are movable in relation to each other and/or in relation to the door drive. Hereby, it will be achieved that the one regulating valve or at least one of the several regulating valves be particularly easy to mount. Hereby, the first and the second valve pistons may be rigidly connected to each other via a catch.

Furthermore, it may be intended that the first valve piston or the second valve piston or at least one of the several first valve pistons or second valve pistons include a right-handed thread and the associated other valve piston includes a left-handed thread, wherein the valve pistons are guided in corresponding right-handed, respectively left-handed threads. Hereby, it will be achieved that the valve pistons respectively associated to each other, in case of a rotation in the same direction are entrained into rotation in opposite directions about the longitudinal axis of the regulating valve.

Furthermore, it may be intended that the one first valve piston or at least one of the several first valve pistons include an axially oriented reception compartment and the associated second valve piston includes a regulating pin, wherein the regulating pin protrudes at least partially into the reception compartment. Hereby, it will be achieved that the one first valve piston or at least one of the several first valve pistons and the associated second valve piston mutually reliably guide each other.

Furthermore, it may be intended that the one regulating pin or at least one of the several regulating pins include in particular a cone-shaped or a truncated tip, wherein the tip together with the associated reception compartment forms an annular gap valve. Hereby, it will be achieved that a clearly defined annular gap be formed, the dimension of which is adjustable by means of a relative movement of the first valve piston and of the second valve piston. Hereby, the annular gap is configured between the tip of the regulating pin and an inner walling of the reception compartment.

Furthermore, it may be intended that an orifice be disposed between the one regulating pin or at least one of the several regulating pins and the associated reception compartment, wherein the covering degree of the orifice opening depends on the position of the first valve piston and/or the second valve piston in relation to the position of the orifice. Hereby, it will be achieved that in a simple manner the regulating pin together with the associated reception compartment and the orifice form a so-called orifice valve. Hereby, the orifice may also be configured as an integral component of the first valve piston or of the second valve piston. As an alternative, the orifice may be indirectly, for example via the valve sleeve, or directly connected to the door drive or configured integrally with the valve sleeve or the door drive. Furthermore, the orifice may be formed by means of a notch orifice. Furthermore, the notch orifice may be formed by means of a notch extending in an axial direction through an orifice sleeve, wherein the orifice sleeve is disposed in the reception compartment and the regulating pin protrudes at least partially into the orifice sleeve.

Furthermore, it may be intended that the one regulating valve or at least one of the several regulating valves extend essentially vertically to the longitudinal axis of the door drive. Hereby, it will be achieved that the regulating valve may be installed into the door drive in a particularly simple manner. In this case, the longitudinal axis of the door drive may be defined by means of the longitudinal axis of an energy accumulator disposed in the door drive, wherein the energy accumulator may be formed in particular by means of a spring, preferably a helical compression spring.

Furthermore, it may be intended that the engaging parts of the one regulating valve or the engaging parts of at least one of the regulating valves be disposed at two opposed sides of the housing.

For example in a cuboid-shaped housing, one engaging part may be disposed at the upper side of the housing and one engaging part at the lower side of the housing or one engaging part may be disposed at the back side of the housing and one engaging part at the front side of the housing or one engaging part may be disposed at a frontal face of the housing and one engaging part at the other frontal face of the housing.

Furthermore, it may be intended that one of the two valve pistons be supported in a thread, whereas the other one of the two valve pistons be exclusively supported to rotatably movable about the longitudinal axis thereof.

Furthermore, it may be intended that one of the two valve pistons includes a catch contour and the other one of the two valve pistons a corresponding engaging element, wherein the catch contour and the engaging element may be brought into engagement with each other such that rotary movements between the valve pistons 9*a*, 9*b* are transferable, i. e. the valve pistons are rotatably coupled.

Furthermore, it may be intended that the valve pistons be mobile in relation to each other in longitudinal direction, i. e. the valve pistons are translationally coupled.

Hereby, it will be achieved that by manipulating one of the engaging parts both valve pistons are rotated in the door drive. Hereby, depending on the rotary direction, the valve pistons either move towards each other or away from each other. Said translational relative movement allows for adjusting the annular gap valve by means of the tip and the reception compartment.

Furthermore, it may be intended that the regulating pin includes a guiding element and the reception compartment includes a guiding area, wherein the guiding element may be guided in the guiding area. In particular, the guiding area may be formed by means of a round interior contour with a constant radius of the reception compartment, and the guiding element may be formed by means of a cylindrical area of the regulating pin, wherein the radius of the round interior contour essentially corresponds to the radius of the cylindrical area.

Hereby, it will be achieved that the play of the annular gap valve, which is formed by means of the regulating pin and the reception compartment, will be reduced. Thus, the regulating valve may be adjusted more precisely.

Furthermore, the above derived and illustrated problem will be solved based on the method for manufacturing a door drive described in the introduction, furthermore, in that the method comprises the following steps:

providing a door drive with a housing for accommodating at least one regulating valve for the adjustable regulation of a fluid flow within the door drive, manufacturing at least one regulating valve, wherein the one regulating valve or the several regulating valves includes at least two ends with respectively one engaging part, in particular for a tool, inserting the one regulating valve or the several regulating valves into the housing such that the one regulating valve or the several regulating valves extend in such a way through the housing that the engaging parts for adjusting the one regulating valve or the several regulating valves may be manipulated from outside the housing. Hereby, it will be achieved that a door drive be manufactured, in which, even if one engaging part of the door drive is for example concealed on account of the mounting position and therefore may not be manipulated, at least one other engaging part continues to be accessible for an operator.

Furthermore, the above derived and illustrated problem will be solved based on the method for adjusting the regulation of a fluid flow within a door drive described in the introduction furthermore in that the method comprises the following steps:

mounting the door drive according to any of the claims 1 to 13 to a door, manipulating one of the engaging parts, in particular by means of a tool.

Features and details, which have been described in conjunction with the inventive door drive, are in this case also valid in conjunction with the inventive method and vice versa. In this case, the features mentioned in the description and in the claims, respectively individually on their own or in combination may be essential to the disclosure. In particular are claimed a method, which may be performed with a door drive according to any of the claims 1 to 13, and a door drive, by means of which a method may be performed according to any of the claims 14 to 15.

BRIEF DESCRIPTION OF THE DRAWINGS

Hereinafter, the disclosure will be explained in more detail, on the basis of exemplary embodiments. Technical features having the same function are numbered in the Figures with the identical reference numerals. In the drawings.

DETAILED DESCRIPTION OF THE DRAWINGS

Figure 1:
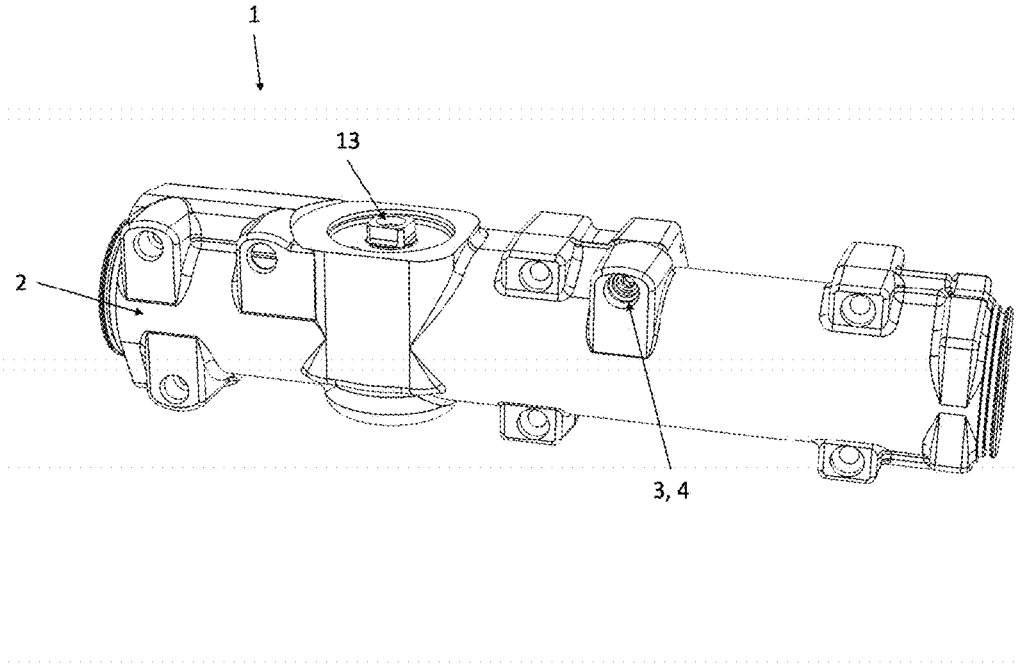
FIG. 1 shows diagrammatically an inventive door drive according to an embodiment of the disclosure.

FIG. 1 shows a door drive 1 with a housing 2. The door drive 1 includes a regulating valve 3 for the adjustable regulation of a fluid flow within the door drive 1. The regulating valve 3 extends in such a manner through the housing 2 of the door drive 1, that the engaging parts 4 for adjusting the regulating valve 3 may be manipulated from outside the housing 2. The engaging parts 4 of the regulating valve 3 are located on opposite sides of the housing 2 such that in FIG. 1 only one engaging part 4 is visible. Via an output shaft 13, the door drive 1 is connectable in a known manner to a force-transmitting element, such as a scissor-arm assembly or a sliding rail.

Figure 2:
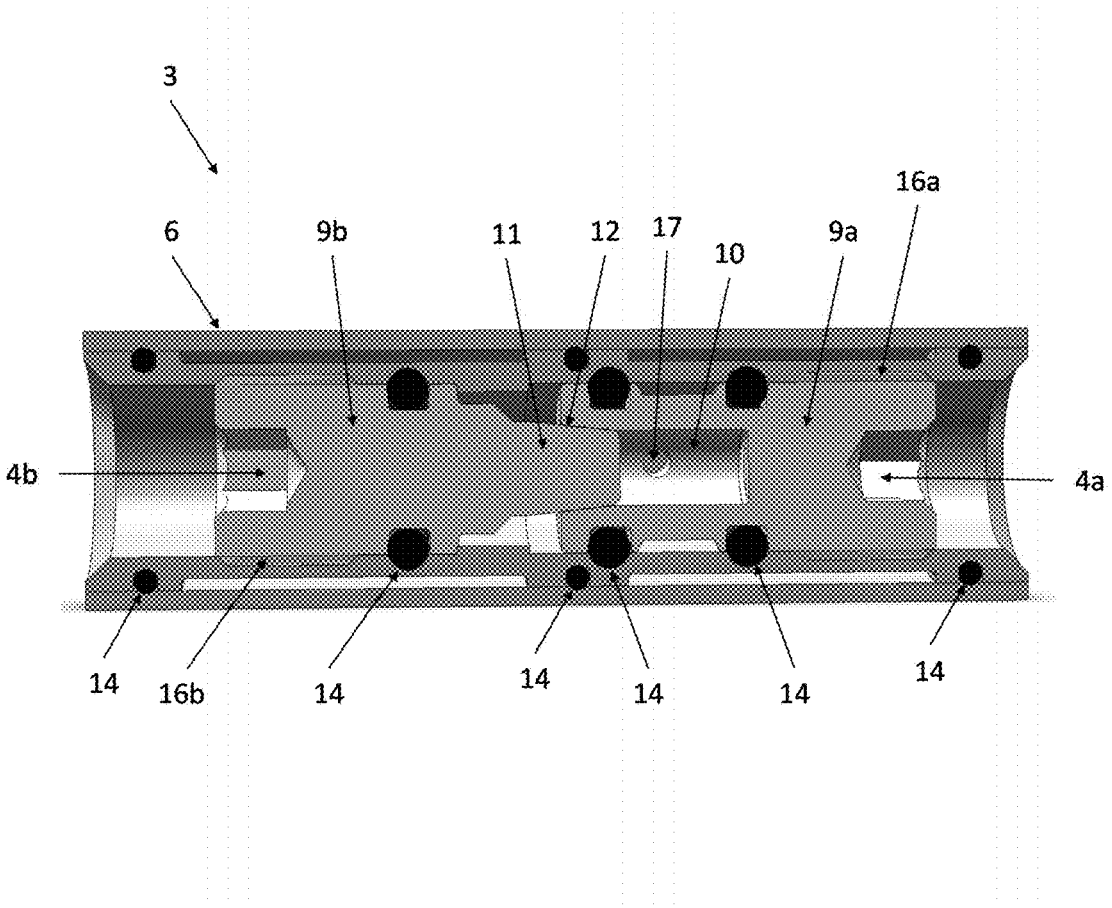
FIG. 2 shows a regulating valve of an inventive door drive according to an embodiment of the disclosure.

The regulating valve 3 illustrated in FIG. 2 includes two ends with respectively one engaging part 4*a*, 4*b*. The regulating valve 3 is supported in a valve sleeve 6. The valve sleeve 6 includes non-illustrated lateral openings for passing a fluid flow therethrough. The regulating valve 3 is non-positively and/or positively and/or positively by material accommodated in the door drive 1 via the valve sleeve 6. The regulating valve 3 includes a first valve piston 9*a* and a second valve piston 9*b*, wherein the first valve piston 9*a* includes the first engaging part 4*a* and the second valve piston 9*b* includes the second engaging part 4*b*. The first valve piston 9*a* is movable in relation to the second valve piston 9*b*. The first valve piston 9*a* is rotatably supported in a thread 16*a*. The second valve piston 9*b* is rotatably supported in a thread 16*b*. The first valve piston 9*a* includes a reception compartment 10. The second valve piston 9*a* includes a regulating pin 11, wherein the regulating pin 11 protrudes into the reception compartment 10. The regulating pin 11 includes a truncated tip 12, wherein the truncated tip 12 together with the reception compartment 10 forms an annular gap valve. Manipulating one of the engaging parts 4*a*, 4*b* allows for adjusting a distance between the two valve pistons 9*a*, 9*b*. Depending on the distance of the two valve piston 9*a*, 9*b* with regard to each other, hydraulic fluid may flow from or into the reception compartment 10 through the annular gap formed between the reception compartment 10 and the truncated tip 12. For this purpose, the reception compartment 10 has a passage 17, which includes a fluid connection to one of the lateral openings of the valve sleeve 6. Analogously, the space around the base of the truncated tip 12 includes a fluid connection to one of the other lateral opening of the valve sleeve. The fluid communications are limited by means of ring-shaped sealing elements 14.

Figure 3:
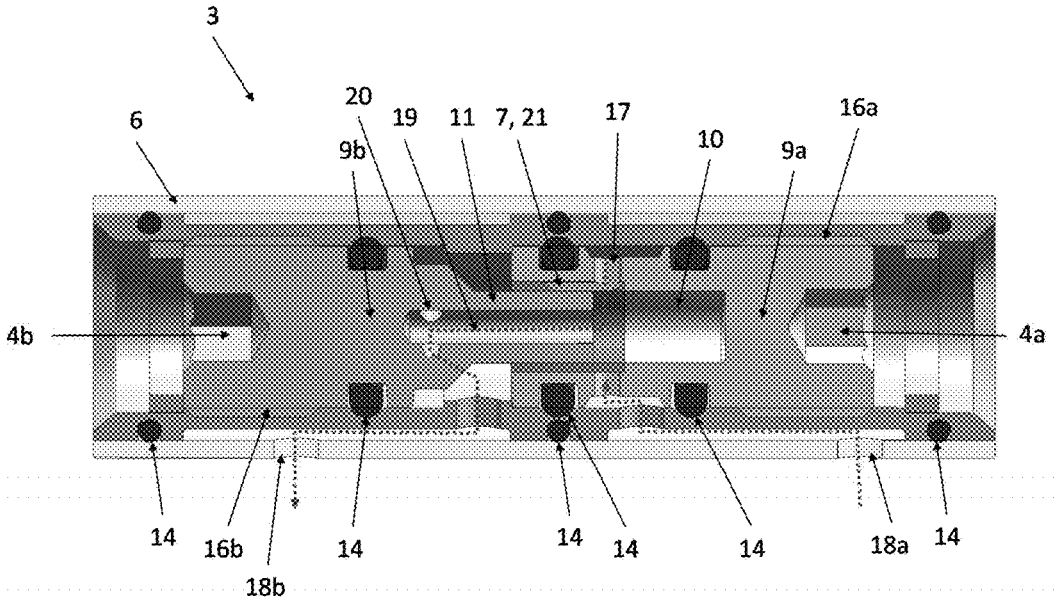
FIG. 3 shows a regulating valve of an inventive door drive according to another embodiment of the disclosure.

The regulating valve 3 illustrated in FIG. 3 is designed mainly identically to the regulating valve 3 illustrated in FIG. 2, so that the description of FIG. 2 may essentially apply to the FIG. 3. In contrast to the regulating valve 3 of FIG. 2, the regulating pin 11 of the regulating valve 3 of FIG. 3 does not have a truncated tip. The regulating pin 11 includes a bore 19 extending in axial direction. The bore 19 extends from the side of the regulating pin 11 oriented towards the first valve piston 9*a* as far as into the second valve piston 9*b*. Thus, the bore 19 is in direct communication with the reception compartment 10. At the end of the bore 19, a transverse channel 20 is disposed, which establishes a fluid communication between the bore 19 and a second lateral opening 18*b* of the valve sleeve 6. An orifice sleeve 7 is disposed between the regulating pin 11 and the reception compartment 10. The orifice sleeve 7 includes a notch 21 extending in axial direction. The regulating pin 11 partially protrudes into the orifice sleeve 7. The regulating pin 11 bears against the inner walling of the orifice sleeve 7 in a fluid-tight manner. Depending on the distance of the two valve pistons 9*a*, 9*b* to each other, the regulating pin 11 does not cover the notch 21, covers it partially or completely. Thus, the regulating pin 11, together with the orifice sleeve 7, forms an orifice valve, which may regulate a fluid flow. One potential path of a fluid through the regulating valve 3 is illustrated by means of the dotted line. In this case, the fluid flows via the first lateral opening 18*a*, through the passage 17 and the notch 21 past the regulating pin 11 and into the reception compartment 10. From the reception compartment 10, the fluid flows through the bore 19 and into the transverse channel 20 towards the second lateral opening 18*b*. The reverse flow path is likewise possible.

Figure 4:
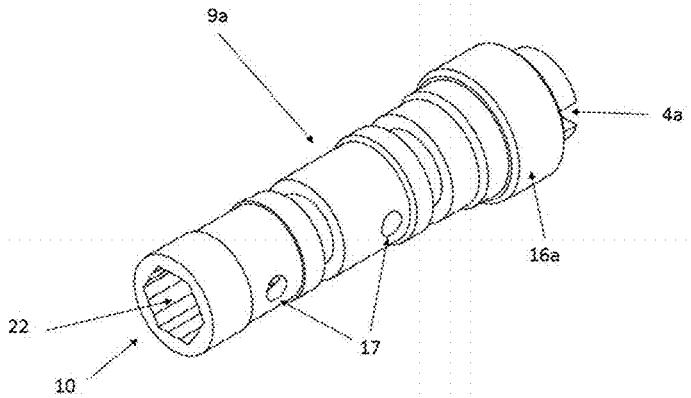
FIG. 4 shows a first valve piston of a regulating valve of an inventive door drive according to a particularly preferred embodiment of the disclosure.
Figure 7:
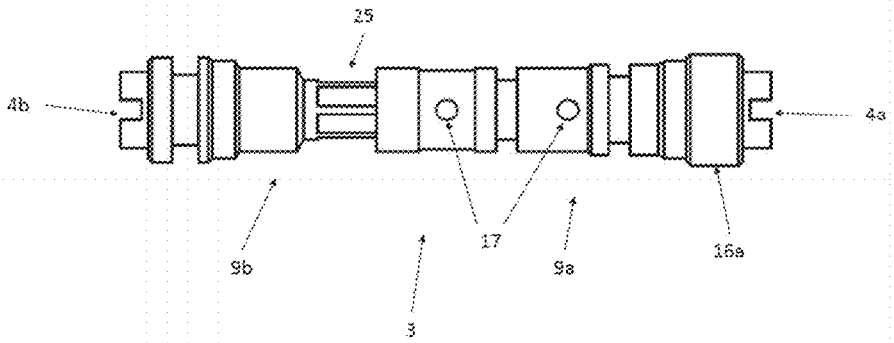
FIG. 7 shows a regulating valve of an inventive door drive according to a particularly preferred embodiment of the disclosure.

FIG. 4 shows the first valve piston 9*a* of the regulating valve 3 illustrated in FIG. 7. The first valve piston 9*a* includes a first engaging part 4*a*. The first valve piston 9*a* includes a reception compartment 10. The engaging part 4*a* and the reception compartment 10 are disposed at opposite ends of the first valve piston 9*a*. The first valve piston 9*a* includes a first thread 16*a*. By means of the first thread 16*a*, the first valve piston 9*a* may be supported to be mobile in a door drive. The first valve piston 9*a* has two passages 17. A fluid flow to be regulated may flow through the passages 17. The first valve piston 9*a* includes a catch contour 22. The catch contour 22 is disposed in the frontal area of the reception compartment 10. The catch contour 22 is formed by means of the non-round interior contour of the reception compartment 10.

Figure 5:
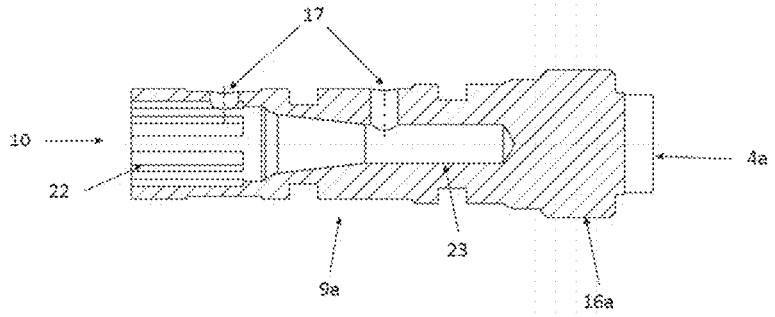
FIG. 5 shows a sectional illustration of the first valve piston of a regulating valve of an inventive door drive according to a particularly preferred embodiment of the disclosure.

FIG. 5 shows the already illustrated first valve piston 9*a* of the regulating valve 3 illustrated in FIG. 7 in a sectional illustration. The reception compartment 10 includes a guiding area 23. The guiding area 23 is disposed in the rear area of the reception compartment. The guiding area 23 is formed by means of a round interior contour with a constant radius of the reception compartment 10.

Figure 6:
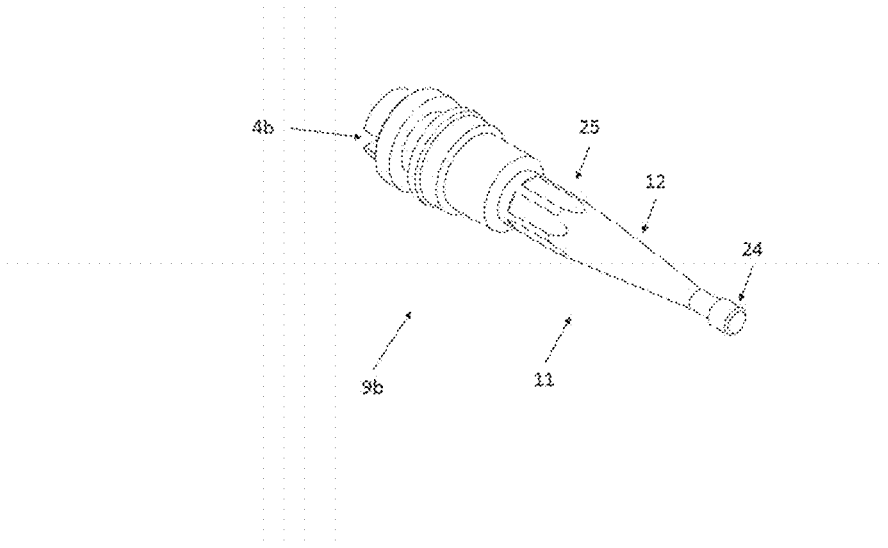
FIG. 6 shows the second valve piston of a regulating valve of an inventive door drive according to a particularly preferred embodiment of the disclosure.

FIG. 6 shows the second valve piston 9*b* of the regulating valve 3 illustrated in FIG. 7. The second valve piston 9*b* includes a second engaging part 4*b*. The second valve piston 9*b* includes a regulating pin 11. The engaging part 4*b* and the regulating pin 11 are disposed at opposite ends of the second valve piston 9*b*. The second valve piston 9*b* includes a tip 12. The tip 12 is essentially configured truncated. The tip 12 is disposed at the regulating pin 11. The second valve piston 9*b* includes a guiding element 24. The guiding element 24 is disposed at the regulating pin 11. The guiding element 24 is disposed at the end of the second valve piston 9*b* opposite the second engaging part 4*b*. The guiding element 24 is formed by means of a cylindrical area of the regulating pin 11. The second valve piston 9*b* includes an engaging element 25. The engaging element 25 is disposed at the regulating pin 11. The engaging element 25 is formed by means of a non-round exterior contour of the regulating pin 11.

FIG. 7 shows an inventive regulating valve 3. The regulating valve 3 includes a first valve piston 9*a* and a second valve piston 9*b*. With the non-illustrated tip, the second valve piston 9*b* extends into the first valve piston 9*a*. The first valve piston 9*a* corresponds to the first valve piston 9*a* illustrated in the FIGS. 4 and 5. The second valve piston 9*b* corresponds to the second valve piston 9*b* illustrated in FIG. 6. The illustration of sealing elements has been omitted for better clarity in the FIGS. 4 to 7. The non-illustrated guiding element 24 is guided in the likewise not illustrated guiding area 25. Said guiding reduces the play, which is formed by means of the tip 12 and the reception compartment 10 of the annular gap valve. Thus, the regulating valve 3 may be adjusted more precisely. The engaging element 25 engages into the non-illustrated catch contour 22. The engaging element 25 and the catch contour 22 have corresponding contours. Hereby, the rotary movements between the valve pistons 9*a*, 9*b* are transmitted, i. e. the valve pistons 9*a*, 9*b* are rotatably coupled. The valve pistons 9*a*, 9*b* are movable in longitudinal direction in relation to each other, i. e. the valve pistons 9*a*, 9*b* are translationally uncoupled. The first valve piston 9*a* is supported via the first thread 16*a* in the non-illustrated door drive. The second valve piston 9*b* is supported in the door drive exclusively rotatably movably supported about the longitudinal axis thereof. By manipulating one of the engaging parts 4*a*, 4*b*, the two valve pistons are rotated in the door drive. Hereby, depending on the direction of movement, the valve pistons 9*a*, 9*b* either move towards each other or away from each other. Said translationally relative movement is adjusted by the annular gap valve formed by means of the tip 12 and the reception compartment 10.

The invention claimed is:

1. A door drive including a housing and at least one regulating valve for the adjustable regulation of a fluid flow within the door drive, wherein the at least one regulating valves includes two ends with respectively one engaging part, wherein the at least one regulating valve extends in such a manner through the housing that the engaging parts are manipulatable for adjusting the at least one regulating valve from outside the housing, wherein the at least one regulating valve is disposed in such a manner that, in any mounting position of the door drive, at least one engaging part per regulating valve is accessible for an operator.

2. The door drive according to claim 1, wherein the at least one regulating valve extends in a bearing or in a thread.

3. The door drive according to claim 1, wherein the at least one regulating valve is supported in at least one valve sleeve, wherein the valve sleeve is accommodated in the door drive.

4. The door drive according to claim 3, wherein the at least one valve sleeve includes at least one lateral opening for passing a fluid flow therethrough.

5. The door drive according to claim 1, wherein an orifice is associated with the at least one regulating valve, wherein the at least one regulating valve cooperates with the associated orifice in such a manner that a covering degree of an orifice opening depends on the position of the at least one regulating valve in relation to the position of the orifice.

6. The door drive according to claim 1, wherein the at least one regulating valve includes a first valve piston and a second valve piston, wherein the first valve piston includes the first engaging part and the second valve piston includes the second engaging part, wherein the first valve piston and the second valve piston are movable in relation to each other and/or in relation to the door drive.

7. The door drive according to claim 1, wherein the first valve piston or the second valve piston or at least one of the several first valve pistons or of the second valve pistons includes a right-handed thread and the associated other valve piston includes a left-handed thread, wherein the valve pistons are guided in corresponding right-handed respectively left-handed threads.

8. The door drive according to claim 1, wherein the first valve piston or at least one of the several first valve pistons includes an axially oriented reception compartment and the associated second valve piston at least one regulating pin, wherein the regulating pin projects at least partially into the reception compartment.

9. The door drive according to claim 8, wherein the at least one regulating pin includes a truncated tip, wherein the truncated tip together with the associated reception compartment form an annular gap valve.

10. The door drive according to claim 8, wherein an orifice is disposed between the at least one regulating pin and the associated reception compartment, wherein the covering degree of the orifice opening depends on the position of the first valve piston and/or the second valve piston in relation to the position of the orifice.

11. The door drive according to claim 1, wherein the at least one regulating valve extends essentially vertically to the longitudinal axis of the door drive.

12. A method for adjusting the regulation of a fluid flow within a door drive, wherein the method further includes the following steps:

mounting the door drive according to claim 1 to a door, and manipulating one of the engaging parts, by means of a tool.

13. A method for manufacturing a door drive, the method includes the following steps:

providing a door drive including a housing for accommodating at least one regulating valve for the adjustable regulation of a fluid flow within the door drive, manufacturing at least one regulating valve, wherein the at least one regulating valve include/s at least two ends with respectively one engaging part, inserting the at least one regulating valve into the housing such that the at least one regulating valve extends in such a way through the housing that the engaging parts for adjusting the at least one regulating valve may be manipulated from outside the housing, and at least one engaging part per regulating valve is accessible for an operator, in any mounting position of the door drive.

* * * * *